US005916673A

United States Patent [19]

Fryberg et al.

[11] Patent Number: 5,916,673

[45] Date of Patent: Jun. 29, 1999

[54] RECORDING SHEETS FOR INK JET PRINTING

[75] Inventors: Mario Fryberg, Praroman; Roland Kurzen, St. Antoni; Klaus Haarmann, Marly, all of Switzerland; Diane L. Blednick, Fairview; Daniel R. Rogers, Erie, both of Pa.

[73] Assignee: Ilford AG, Fribourg, Switzerland

[21] Appl. No.: 08/904,241

[22] Filed: Jul. 31, 1997

Related U.S. Application Data

[63] Continuation of application No. 08/385,412, Feb. 8, 1995, abandoned.

[30] Foreign Application Priority Data

Apr. 19, 1994 [GB] United Kingdom ..... 9407685

[51] Int. Cl.[6] ..... B41M 5/00

[52] U.S. Cl. ..... 428/328; 428/195; 428/206; 428/341; 428/342; 428/704

[58] Field of Search ..... 428/195, 211, 428/537.5, 423.1, 447, 473.5, 475.5, 480, 481, 483, 500, 532, 478.2, 697, 698, 206, 323, 328, 341, 342, 704

[56] References Cited

U.S. PATENT DOCUMENTS

| | | | |
|---|---|---|---|
| 4,116,910 | 9/1978 | Rudolphy | 260/25 |
| 4,136,076 | 1/1979 | Daniels | 260/29.6 |
| 4,146,792 | 3/1979 | Stenzel et al. | 250/365 |
| 4,210,566 | 7/1980 | Murray | 260/31.8 |
| 4,246,154 | 1/1981 | Yao | 260/29.6 |
| 4,443,223 | 4/1984 | Kissling et al. | 8/496 |
| 4,452,843 | 6/1984 | Kaule et al. | 428/199 |
| 4,554,181 | 11/1985 | Cousin et al. | 427/261 |
| 4,575,465 | 3/1986 | Viola | 427/261 |
| 4,597,794 | 7/1986 | Ohta et al. | 106/20 |
| 4,636,806 | 1/1987 | Watarai et al. | 346/1.1 |
| 4,783,376 | 11/1988 | Sakaki et al. | 428/511 |
| 4,877,680 | 10/1989 | Sakaki et al. | 428/332 |
| 4,879,166 | 11/1989 | Misuda et al. | 428/212 |
| 4,990,186 | 2/1991 | Jones et al. | 106/22 |
| 5,011,816 | 4/1991 | Byers et al. | 503/227 |
| 5,017,644 | 5/1991 | Fuller et al. | 524/612 |
| 5,074,914 | 12/1991 | Shirota et al. | 106/22 |
| 5,098,475 | 3/1992 | Winnik et al. | 106/22 |
| 5,100,471 | 3/1992 | Winnik et al. | 106/23 |
| 5,104,730 | 4/1992 | Misuda et al. | 428/304.4 |
| 5,118,349 | 6/1992 | Jalon | 106/21 |
| 5,141,797 | 8/1992 | Wheeler | 428/195 |
| 5,180,425 | 1/1993 | Matrick et al. | 106/22 R |
| 5,182,175 | 1/1993 | Sakaki et al. | 428/537.5 |
| 5,224,987 | 7/1993 | Matrick | 106/20 R |
| 5,230,733 | 7/1993 | Pawlowski | 106/22 R |

FOREIGN PATENT DOCUMENTS

| | | |
|---|---|---|
| 0164196 | 12/1985 | European Pat. Off. . |
| 0497071 A1 | 7/1992 | European Pat. Off. . |
| 0534634 A1 | 3/1993 | European Pat. Off. . |
| 0576151 A1 | 12/1993 | European Pat. Off. . |
| 0586079 A1 | 3/1994 | European Pat. Off. . |
| 60-257285 | 12/1985 | Japan . |
| 63-299970 | 12/1988 | Japan . |
| 4201594 | 7/1992 | Japan . |
| 2147003 | 1/1985 | United Kingdom . |

OTHER PUBLICATIONS

"Jet printing with reactive dyes", S.O. et al., JSDC, vol. 109, pp. 147–152 (Apr., 1993).

*Primary Examiner*—Pamela R. Schwartz
*Attorney, Agent, or Firm*—Ostrager Chong; Flaherty & Onofrio

[57] ABSTRACT

A recording sheet for ink jet printing comprising a support having coated onto said support one or more layers receptive for aqueous inks, said coating comprising at least one film forming, hydrophilic polymer or a mixture of film forming hydrophilic polymers and imbedded in this film at least one trivalent salt of a metal of the Group IIIb series of the periodic table of elements or complexes which comprise trivalent ions of the metals of Group IIIb of the periodic table of the elements. In another embodiment the salts or complexes of Group IIIb elements are coated directly on the substrate surface without the presence of the film forming polymer.

40 Claims, No Drawings

RECORDING SHEETS FOR INK JET PRINTING

This application is a continuation of application Ser. No. 08/385,412 filed on Feb. 8, 1995, now abandoned which is a continuation-in-part of Great Britain application 9407685.8 filed on Apr. 19, 1994.

FIELD OF INVENTION

This invention relates to recording sheets suitable for use in an ink jet recording process, particularly it relates to ink receiving sheets where images recorded thereon can be observed by both reflected and transmitted light. Ink jet receiving materials used at the present time have a particular need for improvement in physical and handling properties, particularly in waterfastness and light stability as well as for improved image quality. A preferred embodiment of this invention is therefore directed towards ink jet recording materials with improved handling and performance characteristics, in particular ink receiving materials where the images recorded thereon are resistant to rubbing on the surface or to damage by other physical means, remain intact in contact to water and do not fade when exposed to light even under adverse conditions. The present invention provides a solution towards these problems.

Ink jet printing systems generally are of two types: continuous stream and drop-on-demand. In continuous stream ink jet systems, ink is emitted in a continuous stream under pressure through an orifice or nozzle. The stream is perturbed, causing it to break up into droplets at a fixed distance from the orifice. At the break-up point, the droplets are charged in accordance with digital data signals and passed through an electric static field which adjusts the trajectory of each droplet in order to direct it to a gutter for recirculation or a specific location on a recording medium. In drop-on-demand systems, a droplet is expelled from an orifice to a position on a recording medium in accordance with digital data signals. A droplet is not formed or expelled unless it is to be placed on the recording medium.

Although the main effort in this invention is directed towards the more demanding continuous stream system it is not meant to be restricted to either of the two methods.

BACKGROUND ART

The following requirements describe some of the major features of a recording material used in ink jet printing:

1. Sufficient ink absorbing capacity and ink receptivity of the receiving layer to prevent the ink from streaking and from running down during printing, even under conditions where several droplets are deposited in a rapid sequence onto the same spot.

2. Fast drying of the layer surface after printing of the image leading to prints free from tackiness.

3. Excellent colour rendition, no change of the hue of the picture with time.

4. Surface with high gloss.

5. In the case of transparencies, clear, transparent, scatter free receiving layers.

6. Resistance of the image surface of the image to rubbing.

7. Excellent waterfastness of the produced images.

8. Excellent light fastness of the printed images.

9. Excellent archival stability.

10. Excellent physical and handling properties.

The particular problem of waterfastness has in the past been addressed by a wide variety of techniques. Thus solutions to the problem have been proposed for by specific formulations of the inks or alternatively in many cases by specific modifications of the receiving layers. The two approaches have in many cases been combined.

One attempt to improve waterfastness has been the use of reactive dyes. So for instance in U.S. Pat. No. 4,443,223 (Kissling et al.), U.S. Pat. No. 5,098,475 (Winnik et al.), U.S. Pat. No. 5,074,914 (Shirotz et al.), U.S. Pat. No. 5,230,733 (Pawlowski et al.), JSDC (1993) 109, 147 (S. O. Aston et al.) and references cited therein. Although some improvement has been achieved by this technique no satisfactory results can in general be obtained due to the fact that the conditions which are possible in practice in a printing environment are less than optimal and do in general not suffice to achieve reaction of these dyes with given binders. Inks based on colloidal dye dispersions and polymers in inks have been proposed so for in instance in U.S. Pat. No. 5,100,471 (Wink et al.), U.S. Pat. No. 5,017,644 (Fuller et al.), U.S. Pat. No. 4,990,186 (Jones et al.), U.S. Pat. No. 4,597,794 (Kasha et al.), U.S. Pat. No. 4,210,566 (Murrey), U.S. Pat. No. 4,136,076 (Dennison et al.), U.S. Pat. No. 5,224,987 (Matrick et al.), U.S. Pat. No. 5,180,425 (Matrick et al.) and U.S. Pat. No. 4,246,154 (Yao et al.). Inks based on colloidal dyes as well as on hot melt inks, although yielding images with good waterfastness and good light stability, do in many cases lead to images which are not transparent and therefore less suited to be used for projections.

Often involved modifications of the inks have the tendency to give inks liable to show precipitates upon prolonged storage. Such precipitates subsequently tend to clog the nozzles of ink jet printer.

The major attempt to achieve waterfastness in receiving layers has been via the use of polymers, particular cationic polymers in conjunction with inks containing acidic dyes.

U.S. Pat. No. 4,877,680 describes cationic polymers together with neutral binders. Cationically modified polyvinyl alcohol has been described in U.S. Pat. No. 4,783,376. U.S. Pat. No. 4,575,465 claims quaternised polyvinyl pyridine to achieve waterfastness. U.S. Pat. No. 4,554,181 describes the use of a combination of cationic polymers and polyvalent metal salts since only such combinations and not the single elements tend to provide the sought for properties.

Although good waterfastness can in general be obtained with a wide variety of cationic polymers they tend to show a severe drawback in that they impair the light fastness of the printed images.

The introduction of inorganic pigments, fillers, minerals, metal salts and metal oxides have been proposed. U.S. Pat. No. 4,116,910 (Rudolphy et al.) propose the use of derivatives of metals of Group II of the periodic table together with natural resin. JP 6025 7285 (Nakadsugawa et al.) claims an improvement of light stability by addition of transition metal oxides. Waterfastness can preferentially be achieved by addition of metal oxides together with cationic pigments or polymers to the receiving layers. U.S. Pat. No. 5,104,730 (Misuda et al.) and U.S. Pat. No. 4,879,166 (Misuda et al.) describe porous recording sheets where the porous layer is mainly made of pseudo boehmite, a colloidal aluminium oxide hydroxide. Although in general satisfactory waterfastness can be achieved the layers obtained by this method are slightly opaque and show severe tendency to become brittle with time and on exposure to light. All the above mentioned solutions fulfil only partly the requirements of image receiving layers for modern ink jet printing. In many cases these solutions lead moreover only to material suitable for quite restricted applications. Improvements incorporated into ink receiving layers, widely applicable to modern ink jet printing technology, are therefore the scope of this invention.

DISCLOSURE OF THE INVENTION

Accordingly, an object of the present invention is to provide image receiving media for use in ink jet recording which are particularly excellent in water resistance.

Another object of the invention is to provide recording media which achieve waterfastness without affecting the stability of the obtained images against the detrimental effect of light.

A further objective is to obtain recording layers with excellent surface properties showing high resistance to physical damage like for instance scratching, resistance to cracking and moist rubbing on the surface.

Still another objective of the present invention is to provide receiving layers with excellent ink receiving properties.

Another objective of the invention is to obtain recording media which satisfy in sharpness and surface lustre of the recorded image and are free from stickiness of the surface even under highly humid conditions.

A further objective is to provide recording media suitable to be used on ink jet printers of the continuous stream type.

A further object is to provide media which allow the possibility to print images intended to match those on silver halide photographic material.

It is furthermore the objective of this invention to provide clear, scattering free recorded images on transparent base material intended to be projected.

An additional objective of this invention is to obtain a recording medium suitable for office desk top publishing of color graphics which has improved lightfastness.

This invention proposes to achieve above objectives by providing a recording material wherein said receiving material consists of a support, opaque or transparent, onto which has been coated a receiving layer or layers comprising a binder or a mixture of different binders, fillers, natural or synthetic polymers and wherein are imbedded or coated at least one trivalent salt of the metals of Group IIIb of the periodic table of the elements or complexes which comprise trivalent ions of the metals of Group IIIb of the periodic table of the elements.

To these layers can be added a wide variety of additional elements to further improve the pictorial or/and physical properties of the images obtained when printed on an ink jet printer.

BEST MODE OF CARRYING OUT THE INVENTION

The present invention will now be described in detail. The ink receiving sheets according to this invention specifically relate to layers wherein are imbedded or coated trivalent metal salts taken from the Group IIIb or complexes containing trivalent ions of these metals of the periodic table of elements, in particular salts or ions of the metals of atomic number 21, 39, 57 through to 60 and atomic of numbers 63 to 70. Preferred are the salts or complexes of Y, La, Ce, Pr, Nd and Yb. These salts or complexes may be in form of water soluble or in form of water insoluble compounds.

The water soluble metal salts of this invention can be present as halides, salts of most oxo acids, sulphates, nitrates, perchlorates, bromates but also as carbonates, phosphates or hydroxides. Also salts of organic acids can be used.

Often the compounds are present as dissociated hydrated species or aqueous complexes and are in general used as such. The salts of the invention can also be used as mixtures made up of single species. There is no limitation as far as the ratios of the mixtures are concerned.

The compounds of the invention can be used in form of their double salts containing besides the claimed Group IIIb elements Ca, Mg, Ba, Na, K or the like. Double salts can be in form of, for instance, sulphates, nitrates, phosphates or in other forms known to those skilled in the art. The use of metal complexes is equally possible under the terms of the invention. Examples of this type are those with chelating ligands like for instance diketones or organic phosphates. Some of the salts of the claimed compounds when readily water-soluble are introduced into the receiving sheets as aqueous solutions. In many instances the claimed metal derivatives are only sparingly soluble in water and have to be applied in colloidal form or in form of fine dispersions.

The salts or complexes of Group IIIb elements coated directly on the substrate or incorporated into the ink receiving layers of the proposed recording material are added in an amount of 0.05–3.0 g/m$^2$, preferentially in amount of 0.1 to 0.9 g/m$^2$. In the embodiment where the salts or complexes of Group IIIb elements are coated directly on the substrate, they are preferably applied as 3–5% aqueous solutions on the surface of the substrate. After evaporation of the aqueous solution the salts or complexes essentially are absorbed into the substrate surface. In this embodiment a preferred substrate includes a base paper sheet coated with a silica and polyvinyl alcohol matrix prior to application of the coating solution.

The use of the salts or complexes of the group IIIb perform most efficiently when they are imbedded into layers or coated onto substrates which have the ability to rapidly absorb aqueous inks. The absorbing power of the layer is to a great extent a function of the materials used but likewise of the physical properties of the layers and the substrate. The compounds that make up the imbedding matrix include in general water soluble film forming polymers.

These film forming water soluble polymers may include, for example, natural polymers or modified products thereof such as albumin, gelatine, casein, starch, gum arabic, sodium alginate, hydroxyethyl cellulose, carboxylmethyl cellulose, α-, β- or γ-cyclodextrine and the like; polyvinyl alcohol; complete or partial saponified, products of copolymers of vinyl acetate and other monomers; homopolymers or copolymers with other monomers of unsaturated carboxylic acids such as (meth) acrylic acid, maleic acid, crotonic acid and the like; homopolymers or copolymers with other vinyl monomers of sulfonated vinyl monomers such as vinylsulfonic acid, sulfonated styrene and the like; homopolymers or copolymers with other vinyl monomers of (meth)acrylamide; homopolymers or copolymers with other monomers of ethylene oxide; polyurethanes, polyamides having such groups as mentioned above; polyethyleneimine, polyacrylamides, water soluble nylon type polymers, polyvinylpyrrolidone, polyester; and so on. All these can also be used in mixtures.

These polymers can be blended with non water soluble natural or synthetic high molecular compounds.

Suitable synthetic polymer materials can be chosen from among poly(vinyllactams, acrylamide polymers, polyvinyl alcohol and its derivatives, polyvinylacetals, polymers of alkyl and sulfoalkyl acrylates and methacrylates, hydrolyzed polyvinyl acetates, polyamides, polyvinyl pyridines, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-diallylaminoalkyl acrylates, vinyl imidazole copolymers, vinyl sulphide copolymers, halogenated styrene polymers, amineacrylamide polymers, polypeptides and the like.

Non-water soluble polymers can also be used in some cases.

In the case where one of the water-soluble polymers is gelatine the types of gelatine suitable for use in the present invention include all kinds of gelatine currently known, for instance acid pigskin or limed bone gelatine, acid or base hydrolysed gelatines, but also derivatised gelatines like for instance phthalated, acetylated or carbamoylated, or gelatine derivatives with trimellytic acid. The preferred gelatine is a gelatine with an isoelectric point between 7 and 9.5.

The polymers mentioned above having reactive groups or groups having the possibility to react with a crosslinking agent can be cross linked to form essentially non water-soluble layers. Such crosslinking bonds may be either covalent or ionic. Thus crosslinking allows for the modification of the physical properties of the layers, like for instance in water absorbency of the layer, but also in resistance against physical damage.

Crosslinking agents suitable for this particular use are selected depending on the water-soluble polymer used. They may include for example chromium salts (such as chrome alum or chromium acetate), aldehydes (such as formaldehyde, glyoxal or glutaraldehyde), N-methylol compounds (such as dimethylolurea or methylol-dimethylhydantoin), dioxane derivatives (such as 2,3-dihydroxydioxane), activated vinyl compounds (such as 1,3,5-triacrylolyl hexahydro-s-triazine or bis(vinylsulfonyl) methyl ether), activated halogen compounds (such as 2,4-dichloro-6-hydroxy-s- triazine), amino or substituted-amino modified triazines, epoxides, carbamoyl-pyridinium compounds or mixtures of two or more of above mentioned crosslinking agents.

The layers and coatings can be modified by addition of fillers. Possible fillers of the kind are for instance kaolin, talcum, Ca- or Ba-carbonate, silica, titanium oxide, chalk, bentonite, zeolite, aluminium silicate, calcium silicate, silicium oxide, colloidal silicium oxide and the like. Likewise the possibility exists to use organic inert particles such as polymer beads. This includes beads made from polyacrylates, polystyrene or different copolymers of acrylates and styrene. These fillers are selected according to the intended use of the printed image. Some of these compounds cannot be used if the printed image is to be used as a transparency. Alternatively they are of interest in cases where the printed image is to be used as a reflected image. Often the introduction of such filler causes a desired matte surface.

The image recording elements of this invention comprise a support for the ink receiving layer. A wide variety of such supports are known and commonly employed in the art. They include, for example, those supports used in the manufacture of photographic clear films including cellulose esters such as cellulose triacetate, cellulose acetate propionate or cellulose acetate butyrate, polyesters such as poly (ethylene terephthalate), polyamides, polycarbonates, polyimides, polyolefins, poly(vinyl acetals), polyethers, polyvinyl chloride and polysulfonamides. Polyester film supports, and especially poly(ethylene terephthalate) are preferred because of their excellent dimensional stability characteristics.

Likewise the usual supports commonly used in manufacturing of opaque photographic material can be used according to the present invention. They include baryta paper, polyethylene-coated paper, polypropylene synthetic paper, voided polyester as for instance manufactured by ICI under the trade name of MELINEX as well as voided polypropylene polyester likewise manufactured by the same company. Preferred are clear polyester, acetate, voided polyester or resin coated paper. When such support material, in particular polyester, is used a subbing layer is advantageously added first to improve the bonding of the ink receiving layer to the support. Useful subbing compositions for this purpose are well known in the photographic art and include, for example, polymers of vinylidene chloride such as vinylidene chloride/acrylonitrile/acrylic acid terpolymers or vinylidene chloride/methyl acrylate/itaconic acid terpolymers. Also usable are plain paper, comprising a wide variety of sizings, cast-coated papers and aluminium foils.

In certain embodiments of the invention, a preferred substrate includes a base paper sheet coated with a silica and polyvinyl alcohol matrix. When such support material is used an aqueous coating of metal salts or complexes of Group IIIb elements may be coated directly on the substrate surface. The inclusion of a film forming polymer in this coating formulation is optional when the described substrate or a similar one is used. This embodiment provides a recording medium suitable for office desk top publishing of color graphics and has improved lightfastness properties.

The ink-receiving layers or coatings according to this invention are in general coated from aqueous solutions or dispersions containing binders, additives, pigments and the like as well as the metal salts or complexes of use in the present invention. It is in many cases necessary to add surfactants to those coating solutions or dispersions allowing for smooth coating and evenness of the layers.

Examples of suitable surfactants are non-ionic surface active agents such as saponin (steroids), alkylene oxide derivatives (such as polyethylene glycol, polyethylene glycol/polypropylene glycol condensates, polyethylene glycol alkyl or alkylaryl ethers, polyethylene glycol esters, polyethylene glycol sorbitan esters, polyalkylene glycol alkylamine or amides or silicone/polyethylene oxide adducts), glycidol derivatives (such as alkenylsuccinic acid polyglycerides or alkylphenol polyglycerides), aliphatic esters of polyhydric alcohols, alkyl esters of sucrose, urethanes or ethers; a sulfuric acid ester group or a phosphoric acid ester group, such as triterpenoid type saponin, alkylcarboxylates, alkylsulfonates, alkylbenzenesulfonates, alkylnaphthalenesulfonates, alkyl sulfuric acid esters alkyl phosphoric acid esters, N-acyl-N-alkyltaurines, sulfosuccinates, sulfo-alkylpolyoxyethynenealkylphenyl ethers or polyoxyethylene alkyl-phosphates and cationic surface active agents such as alkylamine salts, aliphatic or aromatic quaternary ammonium salts (such as pyridinium or imidazolium salts) or phosphonium or sulfonium salt containing an aliphatic or heteroxyclic ring. Equally suitable are fluorinated or perfluorinated derivatives of the above mentioned compounds.

Specific examples of these surface active agents are those described in, e.g. U.S. Pat. Nos. 2,240,472, 1,831,766, 3,158,484, 3,210,191, 3,294,540 and 3,507,660, British Pat. Nos. 1,012,495, 1,022,878, 1,179,290 and 1,198,450, U.S. Pat. Nos. 2,739,891, 2,823,123, 3,068,101, 3,415,649, 3,666,478 and 3,756,828, British Pat. No. 1,397,218, U.S. Pat. No., 1,397,218, U.S. Pat. Nos. 3,133,816, 3,441,413, 3,475,174, 3,545,974, 3,726,683 and 3,843,368, Belgium Pat. No. 731,126, British Pat. Nos. 1,138,514, 1,159,825 and 1,374,780, 2nd U.S. Pat. Nos. 2,271,623, 2,288,226, 2,944,900, 3,253,919, 3,671,247, 3,772,021, 3,589,906 and 3,754,924, all incorporated by reference.

Besides being necessary for coating purpose surfactants may have an influence on the quality of the generated images and may therefore be selected with this specific goal in mind. There is in general no limitation to the use of the types of surfactants used as long as they do not interfere with the metal salts and complexes used in the present invention and later with the printing inks used for the production of the image.

Typically the receiving layers according to this invention have a thickness in the range of 0.5 to 30 microns, preferably in the range of 2.0 to 15 microns dry thickness.

The coating solutions or coating dispersions can be coated onto a support by any number of suitable procedures. Usual coating methods include immersion or dip coating, roll coating, air knife coating, extrusion, doctor blade coating, cascade coating, curtain coating, rod coating, rod and/or blade metering, or by spraying. An ink receiving system can be built up by several layers. These layers can be coated one after the other or simultaneously. It is likewise possible to coat a support on both sides with ink receiving layers. Alternatively the backside may be coated with auxiliary layers like for instance anticurl layers or antistatic layers. The way however by which the claimed receptive layers are produced is not to be considered limiting for the present invention. In addition to the above mentioned elements ink receiving layers as claimed in this invention can contain additional additives aimed at improving appearance as well as performance of the produced imaging material. It can for instance be beneficial to add brightening agents to the layers of receiving sheets. There is in general no limitation as to the kind of brighteners used. Suitable brightening agents are for instance stilbenes, coumarines, triazines or oxazoles or others known in the art.

Light stability can in general be improved further by adding UV absorbers to the layers. Although UV absorbers are in general added to the topmost layer of the system there is no limitation as to where within the ink receiving element such light absorbing compounds are added. The amount of UV-absorber can vary from 200–2000 mg/m$^2$, preferably however from 400 mg to 1000 mg/m$^2$. Suitable types of absorbers can be for example benztriazoles, benzophenones, derivatives of acrylonitrile, thiazolidone, oxazole and thiazole.

It is further known that images can be protected from degradation by the addition of light stabilizers and antioxidants. Examples of such compounds are among others sterically hindered phenols, sterically hindered amines, chromanols and the like. Above mentioned additives can, if water-soluble, be added as aqueous solutions. In the case where these compounds are not water soluble the above mentioned additives can be incorporated in the ink receiving element by common techniques known in the art. The compound is typically dissolved in a solvent selected from organic solvents compatible with water, such as alcohols, glycols, ketones, esters, amides and the like. Alternatively the compounds can be added to the layer as fine dispersions, as oil emulsions, as cyclodextrine inclusion complex or loaded as fine dispersions on to latex particles. Ultrasound or milling can be used to dissolve or disperse marginally soluble additives.

Inks for ink jet printing are well known. These ink consist in essence of a liquid vehicle and dissolved or suspended therein a dye or pigment. The liquid vehicle of the inks employed for the printing according to the present invention consist in general of water or a mixture of water and a miscible organic component such as ethylene glycol, and higher molecular glycolds, glycerine, dipropylene glycol, polyethylene glycol, amides, polyvinylpyrrolidone, N-methylpyrrolidone, cyclohexylpyrrolidone, carboxylic acids and esters, ethers, alcohols, organosulfoxides, sulfolane, dimethylformamide, dimethylsulfoxyde, cellosolve, polyurethanes, acrylates and the like.

The non water part of the printing ink generally serves as humefactant, cosolvent, viscosity regulating agent, ink penetration additive, levelling agent or drying agents. The organic component has in most cases a boiling point which is higher than that of water. In addition aqueous inks may contain inorganic or organic salts to impart electrical conductivity. Examples of such salts include nitrates, chlorides, phosphates and the like and salts of low molecular, water soluble organic acids like acetates, oxalates and similar. The dyes and pigments suitable for the preparation of inks usable with the receiving sheets of this invention cover practically all classes of known colouring compounds. Dyes or pigments typically used for that purpose are described in EP 0 559 324 (Isganitis et al.).

Other additives present in usable inks are for instance surfactants, optical brighteners UV absorbers or light stabilisers, biocides and polymeric additives. This description of inks is for illustration only and not to be considered as limiting the invention.

The following test procedures were used to evaluate and compare the ink receiving sheets described in the present invention, unless otherwise specified in the examples.

Waterfastness

Test sheets prepared according to the described examples were printed on an IRIS ink jet printer model 3024 with standard Iris writing fluids. 1 cm by 1 cm uniform patches were printed in cyan, magenta, yellow and black to a density of about 2. After printing and drying under ambient conditions for 12 hrs the density of the individual patches were measured with an X-rite densitometer. The samples were then placed in deionized water at 20° C. for one minute. After one minute the samples were removed from the water, allowed to drip dry and remeasured. The difference between the densitometer readings was recorded as % loss of optical density and termed waterfastness.

Light Stability

Printed sample sheets obtained according to the same procedure as needed for the above described water fastness test were measured on the X-rite densitometer and exposed in an Atlas Weather-Ometer with a 2500 W-Xenon lamp under conditions analogue to those set for in ISO norm 10 977. The samples were exposed until a total illumination of 40 kJoule/$cm^2$ was reached. The results were reported as % loss of density as determined by the difference of the readings before and after exposure.

EXAMPLE 1

18 g gelatine with an isoelectric point of over seven (Stoess type 70810) were dissolved in 360 ml deionized water. To this solution were added 12 g hydroxyethyl cellulose. (Tylose H20, obtained from Hoechst AG) and 1.0 g of a surfactant (Olin 10G, obtained from Olin Corporation). This solution was divided into twelve equal portions and to each portion was added the amount of metal-nitrate×$H_2O$ indicated in Table 1. This amount corresponds to 0.125 mMol nitrate-salt/g total binder. A control solution contained no salt. Immediately before coating 0.55 g of a 3% solution of 2-(4-dimethyl-carbamoyl-pyridino)-ethane-sulfonate was added to each portion. These solutions were then coated onto a subbed polyester support using a barcoater. The final dry thickness of the layers were approximately 8$\mu$. After drying at room temperature for 12 hours the prepared ink receiving sheets were treated as described in the above testing procedures. The obtained results are reported in Table 1.

TABLE 1

| Metal Salt × | | | Waterfastness Loss of Density in % of initial Density | | | |
|---|---|---|---|---|---|---|
| $H_2O$ | g/g Binder | | C | M | Y | K |
| $La(NO_3)_3$ $6H_2O$ | 0.054 | 1[1] | <1 | 4 | 8 | 6 |
| $Eu(NO_3)_3$ $6H_2O$ | 0.056 | 1 | <1 | 4 | 9 | 9 |
| $Yb(NO_3)_3$ $SH_2O$ | 0.056 | 1 | <1 | 3 | 11 | 5 |
| $Ce(NO_3)_3$ $6H_2O$ | 0.054 | 1 | <1 | 3 | 9 | 8 |
| $Nd(NO_3)_3$ $6H_2O$ | 0.055 | 1 | <1 | 5 | 11 | 12 |
| $Y(NO_3)_3$ $5H_2O$ | 0.046 | 1 | <1 | 4 | 7 | 9 |
| $Mg(NO_3)_2$ $6H_2O$ | 0.032* | c[2] | 19 | 17 | 36 | 27 |
| $Ba(NO_3)_2$ | 0.033* | c | 21 | 12 | 27 | 27 |
| $Ca(NO_3)_2$ $4H_2O$ | 0.030* | c | 27 | 18 | 33 | 27 |
| $Zn(NO_3)_2$ $6H_2O$ | 0.037* | c | 26 | 20 | 39 | 29 |
| $Al(NO_3)_3$ $9H_2O$ | 0.047 | c | 45 | 11 | 13 | 29 |
| None | 0 | c | 36 | 20 | 31 | 36 |

KEY:
[1]: Invention
[2]: Comparison
*Coatings with most of the comparative salts were cloudy and could not possibly be used for transparent ink receiving material.

From the results in Table 1 can be seen that excellent waterfastness can be achieved with recording media according to the present invention while appreciable dye bleeding occurred with salts according to the state of the art.

EXAMPLE 2

Ink receiving sheets were prepared in an analogous way as described in Example 1. In two cases the metal salts were replaced by cationic polymeric mordants (U.S. Pat. No. 4,575,465) as indicated in Table 2.1 and 2.2.

TABLE 2.1

| Metal Salt × | | | Waterfastness Loss in Density % after min. in water | | | |
|---|---|---|---|---|---|---|
| $H_2O$ | g/g Binder | | C | M | Y | K |
| $La(NO_3)_3$ $6H_2O$ | 0.054 | 1 | <1 | 5 | 9 | 8 |
| $Y(NO_3)_3$ $5H_2O$ | 0.056 | 1 | <1 | 3 | 10 | 8 |
| $Ce(NO_3)_2$ $6H_2O$ | 0.054 | 1 | <1 | 6 | 9 | 13 |
| $Mg(NO_3)_2$ $6H_2O$ | 0.032 | c[2] | 18 | 13 | 31 | 23 |
| Mordant 1 [3] | 0.8 | c | 12 | 30 | 33 | 27 |
| Mordant 2 [3] | 0.8 | c | 5 | 12 | 21 | 11 |
| None | | | 37 | 15 | 29 | 31 |

KEY:
[1]: Invention
[2]: Comparison
[3]: US 4,575,465

TABLE 2.2

| Metal Salt × | | | Light stability Loss in Density % after 20kJ Atlas | | | |
|---|---|---|---|---|---|---|
| $H_2O$ | g/g Binder | | C | M | Y | K |
| $La(NO_3)_3$ $6H_2O$ | 0.054 | 1 | 1 | 13 | 30 | 39 |
| $Y(NO_3)_3$ $5H_2O$ | 0.056 | 1 | 4 | 11 | 30 | 40 |
| $Ce(NO_3)_3$ $6H_2O$ | 0.054 | 1 | 0 | 13 | 27 | 39 |
| $Mg(NO_3)_2$ $6H_2O$ | 0.032 | c2 | 9 | 13 | 32 | 31 |
| Mordant 1 [3] | 0.8 | c | 9 | 65 | 47 | 65 |
| Mordant 2 [3] | 0.8 | c | 5 | 93 | 50 | 87 |
| None | | | 9 | 14 | 39 | 37 |

KEY:
[1]: Invention
[2]: Comparison
[3] US 4,575,465

From the results given in Table 2.1 the efficacy of the salts claimed in this invention in improving the waterfastness of the dyes in printed images is evident. It can further-more be, seen from table 2.1 and 2.2 that the efficacy in improving waterfastness by cationic mordants according to the state of the art is considerably lower than with the salts according to this invention. What is however particularly evident is that no deterioration of light stability occurs in presence of these salts where however the stability against light is completely lost in presence of these mordants.

EXAMPLE 3

A coating mixture with a solid content of about 20% was prepared as follows, comprising:

| | | |
|---|---|---|
| 1. | Gelatine (Stoess type 69 426) | 2.4 g |
| 2. | Polyurethane (Daothan 1226 Hoechst, 40% aqueous sol.) | 3.0 g |
| 3. | Kaolin | 10.0 g |
| 4. | Olin 10G (Surfactant, Olin Corp.) | 0.1 g |
| 5. | Crosslinker (idem Example 1) | 0.05 g |
| 6. | $La(NO_3)_3$, $H_2O$ | 5.0 g |
| 7. | Water to 100 g | |

This mixture was bar coated onto an unsized high quality paper in an amount of 1.2 g/$m^2$ (sample A). A control (sample B) was prepared in an analogous way but without the addition of Lanthanum salt. Waterfastness and light stability were determined as described above. The results are shown in Table 3.1.

TABLE 3.1

| | Waterfastness: % Loss (1 Minute Water) | | | | Light Stability: % Loss (20 KJ Atlas) | | | |
|---|---|---|---|---|---|---|---|---|
| Sample | C | M | Y | K | C | M | Y | K |
| A | <1 | 5 | 41 | <1 | 3 | 56 | 27 | 27 |
| B | 13 | 25 | 87 | 31 | 7 | 67 | 50 | 60 |

The same samples were prepared but coated onto heavy weight water colour paper. The results are shown in Table 3.2.

TABLE 3.2

| | Waterfastness: % Loss (1 Minute Water) | | | | Light Stability: % Loss (20 KJ Atlas) | | | |
|---|---|---|---|---|---|---|---|---|
| Sample | C | M | Y | K | C | M | Y | K |
| A | <1 | <1 | 14 | <1 | 3 | 35 | 33 | 33 |
| B | 13 | 32 | 73 | 39 | 6 | 32 | 68 | 66 |

The results in Table 3.1 and 3.2 clearly show the effect of the Lanthanum-salt on diffusion of the dyes in water, also in the case where the claimed system is applied to plain paper. Light stability is in both cases improved when compared to the sample not containing lanthanum salt.

EXAMPLE 4

In this example lanthanum nitrate coatings were applied directly to a substrate surface and were evaluated for lightfastness and tendency to fade.

Four samples A, B, C & D were prepared. The substrate used in all samples is a base paper sheet coated with a silica and polyvinyl alcohol matrix. Particular physical details of the support are as follows:

| 24 lb base sheet (Lock Haven - alkaline, wood fiber matrix - 60/40 hardwood/softwood) 25% CaCO3 filler (precipitated HO/LO); internally sized with ASA; surface sized with starch. | |
|---|---|
| Physical properties of the base sheet include: | |
| Basis Weight | 24 lb |
| Caliper (mils 0.001 inch) | 4.0 |
| Moisture (percent) | 4.8 ± .5 |
| Sheffield Smoothness (Sheffield units) | 40 |
| Porosity (Gurley) | 60 |

The base sheet has a brightness (GE percent) of 90+ and opacity (percent) of 94.
Strength properties include: Stiffness (Gurley): 2 mgf; Tear MD & CD both 50+ g and Mullen 30+ psi.

Silica coating: fumed silica 30 parts; precipitated silica 70 parts; polyvinyl alcohol 40 parts; dispersant and surfactants 3.1 parts. This coating is applied to the base sheet in the range of 3–5 lbs./3,000 ft.

The silica coating is applied to the base sheet in 2 applications using a rod coater. A lanthanum nitrate (water soluble salt of Group IIIb) is applied to the surface of the silica coating in either a 4% (Sample B) or a 3% (Sample C) aqueous solution using a rod coater. Other Group IIIb metals that may be used include scandium, yttrium, cerium, neodymium, praseodymium, europium and ytterbium. The backside coating of the substrate consists of a 0.5% calcium sterate solution that is used as an anticurl agent and to reduce the coefficient of friction.

The support without any coating (Sample A), and coated with a quartinary amine dye fixative (Sample D), were used as controls. The amine dye fixative coating formulation includes a quarternised amine ester, lauryldimethylbenzylammoniumchloride, a polyamine salt aqueous solution and a silicone derivative.

Lightfastness Evaluation

The effect of lanthanum nitrate on ink jet printing ink color was evaluated before and after lightfastness testing. Hewlett Packard 500 series ink jet printing ink color was used in this example but any other commercially available color inks are also suitable for use in the invention. Samples A, B, C and D were exposed to carbon arc light for periods of 1, 2 and 4 hours. Color readings (L*A*B*) were taken on exposed and unexposed areas. The results are shown in the Table 4.1 below.

TABLE 4.1

EFFECTS OF TOP COATING ON COLOR (L*A*B*)

| CONDITION | COLOR | L* | A* | B* |
|---|---|---|---|---|
| A - CONTROL | BLACK | 34.43 | −12.04 | −6.49 |
| B | BLACK | 40.70 | −8.31 | −8.43 |
| C | BLACK | 39.69 | −8.89 | −7.13 |
| D - CONTROL | BLACK | 32.43 | −6.64 | −8.00 |
| A - CONTROL | CYAN | 50.85 | −33.09 | −54.05 |
| B | CYAN | 50.05 | −30.65 | −53.91 |
| C | CYAN | 51.30 | −32.51 | −53.59 |
| D - CONTROL | CYAN | 49.71 | −27.07 | −56.35 |
| A - CONTROL | YELLOW | 89.78 | −1.76 | 104.30 |
| B | YELLOW | 89.31 | −0.53 | 100.81 |
| C | YELLOW | 89.66 | −1.70 | 102.51 |
| D - CONTROL | YELLOW | 88.28 | −0.63 | 98.58 |
| A - CONTROL | MAGENTA | 48.88 | 60.84 | −53.20 |
| B | MAGENTA | 47.56 | 57.56 | −54.58 |
| C | MAGENTA | 47.59 | 59.24 | −54.94 |
| D - CONTROL | MAGENTA | 50.67 | 59.80 | −47.09 |

KEY:
Sample A - Control: no lanthanum nitrate
Sample B - 0.651 g/m$^2$ (0.4 lb/3,000 sq. ft.) lanthanum nitrate
Sample C - 0.488 g/m$^2$ (0.3 lb/3,000 sq. ft.) lanthanum nitrate
Sample D - Control: quartinary amine dye fixative The tendency to fade of the coated samples above were also evaluated after exposing treated papers to 1, 2 and 4 hours of carbon arc light. The results are shown in the Table 4.2 below.

TABLE 4.2

THE EFFECTS OF TOP COATING ON FADE

| COLOR | 1 HR. FADE D.E. | 2 HR. FADE D.E. | 4 HR. FADE D.E. |
|---|---|---|---|
| SAMPLE A (CONTROL) | | | |
| BLACK | 7.78 | 10.53 | 25.64 |
| CYAN | 13.91 | 18.58 | 34.54 |

TABLE 4.2-continued

| THE EFFECTS OF TOP COATING ON FADE | | | |
|---|---|---|---|
| COLOR | 1 HR. FADE D.E. | 2 HR. FADE D.E. | 4 HR. FADE D.E. |
| YELLOW | 3.10 | 3.71 | 6.39 |
| MAGENTA | 18.98 | 30.54 | 46.80 |
| | | AVERAGE FADE - 18.29 | |
| SAMPLE B (4% $La(NO_{3)3}$) | | | |
| BLACK | 3.79 | 6.11 | 11.73 |
| CYAN | 18.78 | 24.33 | 35.42 |
| YELLOW | 2.20 | 2.70 | 3.72 |
| MAGENTA | 20.13 | 29.58 | 44.97 |
| | | AVERAGE FADE - 16.95 | |
| SAMPLE C (3% $La(NO_{3)3}$) | | | |
| BLACK | 5.28 | 7.74 | 16.39 |
| CYAN | 16.09 | 22.19 | 33.35 |
| YELLOW | 3.0 | 3.86 | 5.78 |
| MAGENTA | 20.03 | 30.88 | 47.39 |
| | | AVERAGE FADE - 17.66 | |
| SAMPLE D (CONTROL) | | | |
| BLACK | 4.03 | 6.31 | 17.45 |
| CYAN | 27.92 | 40.03 | 66.43 |
| YELLOW | 6.32 | 8.52 | 22.41 |
| MAGENTA | 16.11 | 28.24 | 56.36 |
| | | AVERAGE FADE - 25.01 | |

Results show the lanthanum nitrate coated sheets exhibit less fade than the control (sample A) treated with nothing at all. The amine coated support (sample D) shows that the paper actually gets duller faster than no coating (sample A).

Advantageously, the present invention provides image receiving media for use in ink jet recording which has excellant water resistance and lightfastness. It will be recognized by those skilled in the art that the invention has wide application as a media which allows the possibility to print images intended to match those on silver halide photographic material. Further advantage is obtained by providing a recording medium which is suitable for office desk top publishing of color graphics for ink jet printers.

Therefore, although the invention has been described with reference to certain preferred embodiments, it will be appreciated that other composite structures and processes for their fabrication may be devised, which are nevertheless within the scope and spirit of the invention as defined in the claims appended hereto.

We claim:

1. A recording sheet for ink jet printing comprising a support having coated onto said support at least one layer receptive for aqueous inks, said coating consisting essentially of at least one film forming, hydrophilic polymer or a mixture of film forming hydrophilic polymers and imbedded in this film at least one trivalent salt of a metal of the Group IIIb series of the periodic table of elements or complexes which comprise trivalent ions of the metals of Group IIIb of the periodic table of the elements.

2. An ink jet recording sheet according to claim 1 wherein said salts or complexes are selected from the group consisting of salts or complexes of elements No. 21, 39, 57–60 and 62–71.

3. An ink jet recording sheet according to claim 2 wherein said salts or complexes are selected from the group consisting of salts or complexes of Yttrium, Lanthanum, Cerium, Praseodynium, Neodymium, Europium, Gadolinium, Dysprosium, Erbium and Ytterbium.

4. An ink jet recording sheet according to claim 1 wherein said salts or complexes are selected from the group consisting of salts or complexes of Yttrium, Lanthanum, Cerium, Neodynium and Ytterbium.

5. An ink jet recording sheet according to claim 1 wherein said hydrophilic film forming polymer is a synthetic polymer selected from the group consisting of polyvinyllactams, acrylamide polymers, polyvinyl alcohol, derivatives of polyvinyl alcohol, polyvinylacetals, polymers of alkyl and sulfoalkyl acrylates and methacrylates, hydrolyzed polyvinyl acetates, polyamides, polyvinyl pyridines, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-diallylaminoalkyl acrylates, vinyl imidazole copolymers, vinyl sulphide copolymers, halogenated styrene polymers, amineacrylamide polymers, and polypeptides.

6. An ink jet recording sheet according to claim 1 wherein said hydrophilic film forming polymer is a natural polymer or a modified natural polymer selected from the group consisting of albumin, gelatine, casein, starch, gum arabic, sodium alginate, hydroxyethyl cellulose, carboxylmethyl cellulose, α-, β- and γ-cyclodextrine; polyvinyl alcohol; complete and partial saponified products of copolymers of vinyl acetate, homopolymers and copolymers with monomers of unsaturated carboxylic acids, (meth)acrylic acid, maleic acid, crotonic acid; homopolymers and copolymers with vinyl monomers of sulfonated vinyl monomers, vinylsulfonic acid, sulfonated styrene; homopolymers and copolymers with vinyl monomers of (meth)acrylamide; homopolymers and copolymers with monomers of ethylene oxide; polyurethanes; polyamides; polyvinylacrylamide; polyethyleneimine; polyacrylamides; water soluble nylon polymers; polyvinylpyrrolidone; polyester; and mixtures of these compounds.

7. An ink jet recording sheet according to claim 1 wherein the hydrophilic film forming polymer is selected from the group consisting of gelatine, casein, starch, gum arabic, sodium alginate, hydroxyethyl cellulose, carboxymethyl cellulose, α-, β-, and γ-cyclodextrine, polyvinyl alcohol, complete and partial saponified products of copolymers of vinyl acetate, homopolymers and copolymers with monomers of unsaturated carboxylic acids, (meth)acrylic acid, sulfonated vinyl monomers, vinylsulfonic acid, sulfonated styrene, homopolymers and copolymers with acrylamide, water soluble nylon polymers, polyvinylpyrrolidone, polyurethane and mixtures of these compounds.

8. An ink jet recording sheet according to claim 1 wherein the hydrophilic film forming polymer is selected from the group consisting of gelatine, starch, hydroxyethyl cellulose, α-, β- and γ-cyclodextrine, polyvinyl alcohol; copolymers of vinyl acetate, acrylamide, watersoluble nylon polymers, polyvinylpyrrolidone, polyurethane and mixtures of these compounds.

9. An ink jet recording sheet according to claim 1 wherein said support is coated with two layers of said coating.

10. An ink jet recording sheet according to claim 1 wherein said coating is on both sides of the support.

11. An ink jet recording sheet according to claim 1 further comprising an additional coating layer wherein said layers have different compositions.

12. An ink jet recording sheet according to claim 1 wherein said layers have a thickness of 0.5 to 25$\mu$.

13. An ink jet recording sheet according to claim 1 wherein said hydrophilic polymer in said layer is crosslinked.

14. An ink jet recording sheet according to claim 13 wherein the crosslinking agent is selected from the group consisting of formaldehyde, glyoxal, dihydroxydioxane, dichloro-hydroxy-triazine, chlorodihydroxy-triazine, 2-(4-dimethylcarbamoyl-pyridino)-ethane-sulfonate and 2,2'-Bis-(vinylsulfonyl)-diethyl ether.

15. An ink jet recording sheet according to claim 1 wherein said support is a transparent thermoplastic film.

16. An ink jet recording sheet according to claim 1 wherein said support is an opaque thermoplastic film.

17. An ink jet recording sheet according to claim 1 wherein said support is a resin coated paper.

18. An ink jet recording sheet according to claim 1 wherein said support is plain paper.

19. An ink jet recording sheet according to claim 1 wherein said support is a surface treated plain paper.

20. An ink jet recording sheet according to claim 1 wherein the amount of said metal salt or complex is present in the range of 0.05 to 3.0 g/m$^2$ in the hydrophilic polymer layer.

21. An ink jet recording sheet according to claim 20 wherein the amount of said metal salt or complex is present in the range of 0.1 to 0.9 g/m$^2$.

22. An ink jet recording sheet according to claim 20 wherein said metal salt or complex is present in colloidal form with a particle size $\leqq 0.5\mu$.

23. An ink jet recording sheet according to claim 1 wherein the salts of said metals are salts of mineral acids.

24. An ink jet recording sheet according to claim 1 wherein the salts of said metals are the salts of organic acids.

25. An ink jet recording sheet according to claim 1 wherein said film forming polymer is gelatine or gelatine together with one or more water-soluble polymers and wherein said salts or complexes are water-soluble and are selected from the group consisting of salts or complexes. of Yttrium, Lanthanum and Cerium.

26. An ink jet recording sheet according to claim 1 wherein said coating further contains one or more water-insoluble fillers or pigments.

27. An ink jet recording sheet according to claim 26 wherein the fillers or pigments are selected from the group consisting of clay, talc, zeolytes, calcium-carbonate, barium-carbonate, magnesium-carbonate, calcium-sulphate, barium-sulphate, magnesium-sulphate, satin white, silicon oxide and colloidal silicon oxide.

28. An ink jet recording sheet according to claim 26 wherein said fillers or pigments are selected from satin white, silicon oxide and colloidal silicon oxide.

29. An ink jet recording sheet according to claim 26 wherein said filler is a water-insoluble organic polymer.

30. An ink jet recording sheet according to claim 1 wherein said polymer is gelatine selected from the group consisting of acid pigskin gelatine, limed bone gelatine, acid and base hydrolysed gelatine or derivatives of gelatine.

31. An ink jet recording sheet according to claim 30 wherein said derivatives of gelatine comprise phthalated gelatine, carbamoylated gelatine, acetylated gelatine and trimellytic-acid modified gelatine.

32. An ink jet recording sheet according to claim 1 wherein said polymer is gelatine with an isoelectric point of 7 to 9.5.

33. An ink jet recording sheet according to claim 1 wherein said coating consists essentially of gelatine, water-soluble salts of trivalent metals of Group IIIb and a filler selected from the group consisting of clay, silicon oxide, colloidal silicon oxide, satin-white and an organic polymer.

34. An ink jet recording sheet according to claim 1 wherein said coating consists essentially of gelatine, water-soluble salts of trivalent metals of Group IIIb and a water-soluble polymer or a mixture of water-soluble polymers selected from the group consisting of starch, hydroxyethyl cellulose, $\alpha$-, $\beta$- and $\gamma$-cyclodextrine, polyvinyl alcohol, vinyl acetate, acrylamide, water-soluble nylon polymers and polyvinylpyrrolidone.

35. A recording sheet for ink jet printing comprising a support having coated onto said support at least one layer receptive for aqueous inks, said coating consisting essentially of at least one trivalent salt of a metal of the Group IIIb series of the periodic table of elements or complexes which comprise trivalent ions of the metals of Group IIIb of the periodic table of the elements.

36. An ink jet recording sheet according to claim 35 wherein said salts or complexes are selected from the group consisting of salts or complexes of elements No. 21, 39, 57–60 and 62–71.

37. An ink jet recording sheet according to claim 36 wherein said salts or complexes are selected from a group consisting of salts or complexes of Yttrium, Lanthanum, Cerium, Praseodynium, Neodymium, Europium, Gadolinium, Dysprosium, Erbium and Ytterbium.

38. An ink jet recording sheet according to claim 35 wherein said salts or complexes are selected from the group consisting of salts or complexes of Yttrium, Lanthanum, Cerium, Neodynium and Ytterbium.

39. An ink jet recording sheet according to claim 35 wherein said support is a base sheet coated with a silica and polyvinyl alcohol matrix.

40. An ink jet recording sheet according to claim 35 wherein said coating is applied to said support as a 3–5% aqueous solution of lanthanum nitrate.

* * * * *